United States Patent [19]

Chase

[11] 4,276,708

[45] Jul. 7, 1981

[54] PISTOL RECEIVER ACTUATING MECHANISM

[76] Inventor: Marshall D. Chase, 75 E. Van Buren Rd., Alma, Mich. 48801

[21] Appl. No.: 9,605

[22] Filed: Feb. 5, 1979

[51] Int. Cl.[3] ..... F41C 3/00

[52] U.S. Cl. ..... 42/44

[58] Field of Search ..... 42/44, 45, 40, 16

[56] References Cited

U.S. PATENT DOCUMENTS

| | | | |
|---|---|---|---|
| 112,763 | 3/1871 | Dodge | 42/44 |
| 187,462 | 2/1877 | Eutebrouk | 42/44 |
| 514,414 | 2/1894 | Cilley | 42/44 |
| 3,561,149 | 2/1971 | Center | 42/44 |
| 4,156,980 | 6/1979 | Aspenwall | 42/44 |

*Primary Examiner*—Charles T. Jordan

*Attorney, Agent, or Firm*—Harness, Dickey & Pierce

[57] ABSTRACT

An improved trigger guard for a pistol having trigger guard actuated means has an upwardly and rearwardly extending, elongated lever member which facilitates manual actuation of the trigger guard for opening the breech and setting the trigger mechanism and safety.

10 Claims, 7 Drawing Figures

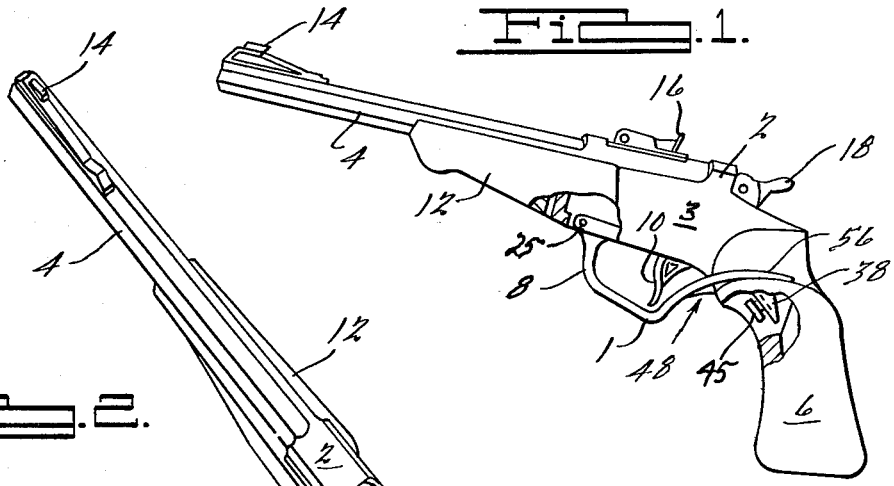
Fig. 1.
Fig. 2.
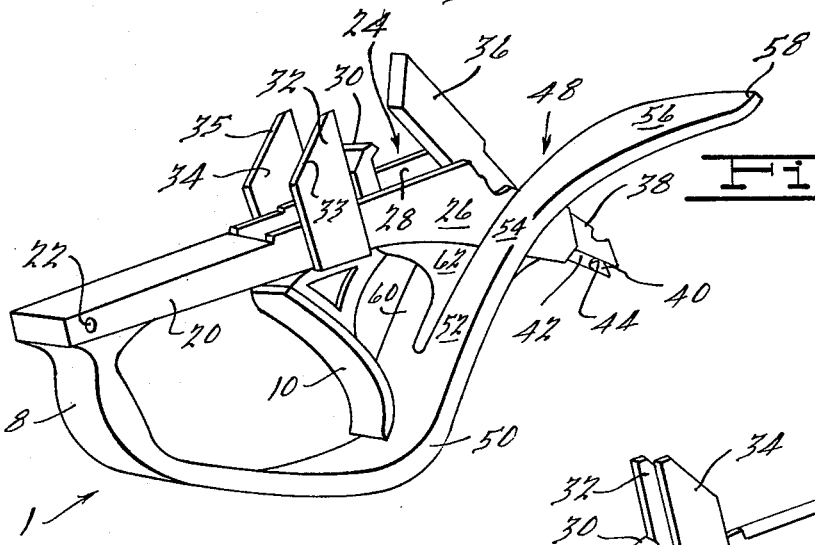
Fig. 3.
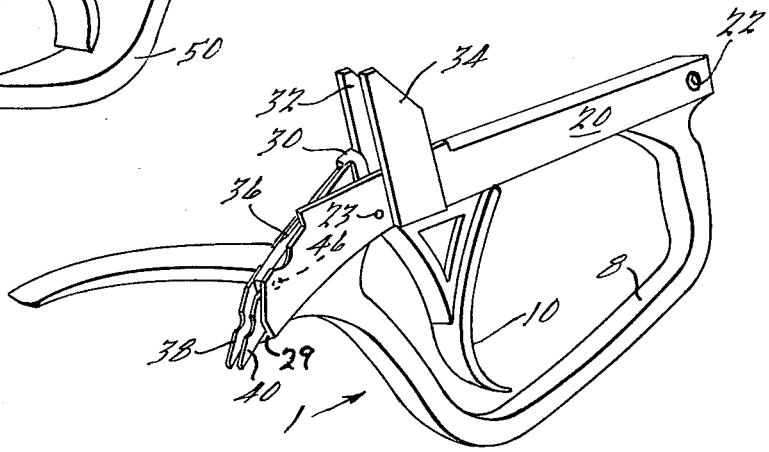
Fig. 4.

PISTOL RECEIVER ACTUATING MECHANISM

BACKGROUND OF THE INVENTION

The present invention relates to an improved trigger guard associated with a pistol having a trigger guard actuated mechanism. More specifically, the present invention relates to a trigger guard having a rearwardly and upwardly extending elongated lever member to facilitate the manual actuation of the trigger guard to operate a trigger guard actuated mechanism.

The present invention provides an improved trigger guard for use in pistols such as the pistol disclosed in U.S. Pat. No. 3,561,149 which issued on Feb. 9, 1971, to Warren A. Center for "Pistol With Means Actuating the Barrel Latch and Setting the Trigger Mechanism and Safety". The trigger guard disclosed in the Center patent has a relatively short, rearwardly and downwardly extending horn which is intended to be manually engaged to actuate the trigger guard which is pivotally mounted with respect to the receiver. Manual actuation of the trigger guard towards the receiver unlocks the receiver, allowing the barrel to swing open to expose the chamber for loading or unloading, and additionally sets the trigger and engages the safety.

It is an object of the present invention to provide an improved trigger guard for use in a pistol having a trigger guard actuated means. It is a specific object of the present invention to provide an improved trigger guard for use in a pistol constructed in accordance with the aforementioned Center patent. One object of the present invention is to provide a trigger guard which is unlikely to come into painful contact with the hand of the shooter. Another object of this invention is to provide an improved trigger guard having a rearwardly and upwardly extending lever member adapted to facilitate manual actuation of the trigger guard and an actuating mechanism associated therewith. Still another object of the present invention is to provide an improved trigger guard which can be economically manufactured and substituted for the trigger guard of a pistol constructed in accordance with the Center patent to thereby provide an improved pistol. These and other objects, features and advantages of the present invention will be apparent from the following disclosure and claims taken in conjunction with the attached drawing.

BRIEF DESCRIPTION OF THE DRAWING

FIG. 1 is a side elevational view, with portions broken away, showing a pistol and trigger guard of the present invention;

FIG. 2 is a plan view of the pistol and trigger guard of FIG. 1 shown slightly angled to show part of the front side;

FIG. 3 is a perspective view of a trigger guard of the present invention viewed from the front; and FIG. 4 is a perspective view of the trigger guard of the present invention viewed from the rear.

DESCRIPTION OF THE INVENTION

The present invention is in the nature of an improved trigger guard providing especially adapted for use in a pistol made in accordance with U.S. Pat. No. 3,561,149 Feb. 9, 1971, to Warren A. Center, which patent is specifically incorporated by reference herein. As will be readily appreciated by those skilled in the art, the improved trigger guard of the present invention is intended for use to replace the trigger guard of the pistol disclosed in the Center patent to provide an improved pistol having a novel and improved trigger guard providing actuating means for unlocking the receiver, setting the trigger mechanism and engaging the safety. Of course, while the present invention is disclosed in the context of the pistol of the Center patent, it will be appreciated that the present invention is applicable to any pistol or other firearm having trigger guard actuated means, and such applications are intended to be within the broad scope of this invention.

Now referring to the drawing, FIG. 1 shows a trigger guard 1 of the present invention in operative association with a pistol 2 having receiver 3 to which barrel 4 is pivotally connected and hand grip 6 is fixidly connected. Pistol 2 is constructed substantially as disclosed in the Center patent, with the exception of trigger guard 1 and attached parts, and has trigger 10, forend 12, front sight assembly 14, rear sight assembly 16, and hammer 18. Trigger guard 1 is designed to be interchangeable with the corresponding trigger guard of the Center patent and provides an improved retrofit therefor.

Trigger guard 1 has a conventional safety guard portion 8 which extends generally downwardly from and is integrally formed with a generally, horizontally extending base 20. At the forward end portion of base 20 is bore 22 which is adapted to receive pin 25 which pivotally attaches trigger guard 1 to receiver 3. Channel portion 24 of base 20 is of generally channel-shaped cross section having sidewalls 26 and 28 and web portion 29. Generally, as in the Center patent, trigger 10 is pivotally attached to base 20 by pin 23 and extends through an aperture in web 29 to provide operative movement of ridge 30 which is adapted to releasably engage bar 36. Bar 36 is pivotally mounted between sidewalls 38 and 40 of an insert 42 by means of pin 46 and is upwardly biased by a spring (not shown in the Figures). Insert 42 is nestingly received in channel portion 24 and is fixidly attached thereto. Notched web 44 of insert 42 is adapted to slidably mount on guard stop screw 45. Means for actuating the receiver unlocking mechanism of pistol 2 is provided by ears 32 and 34 which are fixidly mounted on base 20 and have angled surfaces 33 and 35 adapted, upon upward movement of trigger guard 1 relative to receiver 3, to engage the receiver unlocking mechanism as taught in the Center patent.

As best shown in FIG. 3, trigger guard 1 has an upwardly and rearwardly extending lever member 48 formed integrally with base 20 and safety guard 8. Safety guard 8 extends below and rearwardly of trigger 10 curving upwardly at portion 50 to integrally extend to lever member 48, which begins at portion 52. Thus, portion 52 and a portion 60 of safety guard 8 bifurcating extend on both sides of support web 62 which is integrally formed with base 20 and lever member 48 and extends therebetween. Lever member 48 has intermediate portion 54, rearwardly, generally horizontally extending portion 56, and end portion 58 and has a generally convex arcuate configuration with respect to base 20.

Lever member 48 serves the same functions as the horn associated with the trigger guard of the Center patent. However, lever member 48 is located and constructed to facilitate its manual engagement to effect actuation of trigger guard 1. Thus, rearwardly extending portion 56 of trigger guard lever member 48 lies generally in such a position that the thumb of the shooter's hand falls comfortably along the top surface thereof. It will be appreciated by those skilled in the art that the design of the present invention includes no rearwardly extending trigger guard portion which is likely to come into painful contact with the knuckles of the shooter's hand upon firing of the pistol. Furthermore, it will be appreciated that the location of trigger guard lever member 48 is such that manual engagement to effect upward or downward movement of trigger guard 1 is facilitated. Thus, trigger guard 1 includes a generally upwardly and rearwardly extending, elongated lever member which is integrally formed with safety guard 8 which provides a rest for the user's thumb, facilitates manual actuation of trigger guard 1 and avoids a rearwardly extending trigger guard portion likely to contact a knuckle of the shooter's hand upon firing the pistol.

It will, of course, be appreciated by those skilled in the art that the specific embodiment of the present invention disclosed above is well calculated to achieve the objects hereinbefore set forth. It will also be appreciated that while the above description has been cast in terms of a trigger guard associated with a pistol and a right-handed shooter, uses with other firearms having trigger guard actuated means are contemplated and it is readily apparent that the present invention can be easily modified for a left-handed shooter. It is to be understood that the present invention may be varied within the scope of the appended claims without departing from the spirit thereof.

I claim:

1. A trigger guard for use with a firearm having a trigger guard actuated mechanism, said trigger guard comprising: a generally horizontally extending base; a safety guard member integrally formed with said base and protectively extending in front of and below said base; a rearwardly and upwardly extending elongated lever member integrally formed with said safety member and adapted to be manipulated by the hand of the shooter; means for actuating said mechanism, and a web member extending integrally between a rearward portion of said base and said elongated lever member.

2. A trigger guard as in claim 1 wherein said lever member extends upwardly past one side of said base.

3. A trigger guard as in claim 2 wherein said base has means for pivotally attaching said base to a firearm.

4. A trigger guard as in claim 3 wherein said elongated lever member has a generally convex arcuate configuration with respect to said base.

5. A trigger guard as in claim 4 wherein said base has a rearward portion of channel-shaped cross section and wherein an insert member of channel-shaped cross section is nestingly and fixidly located partially within said rearward portion of channel-shaped cross section.

6. A trigger guard as in claim 5 including a trigger pivotally attached to said base, a pair of ears extending upwardly from said base and fixidly attached thereto, a bar pivotally attached to said base and wherein said web portion of said insert member has a notch therein.

7. A firearm comprising: a receiver; a barrel assembly attached to said receiver; a grip fixidly attached to said receiver; and a trigger guard pivotally attached to said receiver, said trigger guard having rearwardly and generally upwardly extending elongated lever member integral with said trigger guard and extending rearwardly along one side of said grip.

8. A firearm as in claim 7 wherein said elongated lever member has a generally convex arcuate configuration with respect to said receiver.

9. A firearm as in claim 8 wherein said trigger guard includes a generally horizontally extending base and a web member extending between said base and the lower portion of said lever member, said web member being integrally formed with said base and said lever member.

10. A firearm as in claim 9 wherein said firearm is a pistol.

* * * * *

UNITED STATES PATENT AND TRADEMARK OFFICE

CERTIFICATE OF CORRECTION

PATENT NO. : 4,276,708

DATED : July 7, 1981

INVENTOR(S) : Marshall D. Chase

It is certified that error appears in the above—identified patent and that said Letters Patent is hereby corrected as shown below: Column 1, line 62, after "guard" delete --providing--. Column 4, line 4, Claim 6, after "base" insert --,--.

Signed and Sealed this

*Seventeenth* Day of *November 1981*

[SEAL]

*Attest:*

GERALD J. MOSSINGHOFF

*Attesting Officer*

*Commissioner of Patents and Trademarks*